United States Patent [19]

Monds

[11] Patent Number: 4,834,609

[45] Date of Patent: May 30, 1989

[54] SHAFT HANDLING DEVICE

[75] Inventor: Paul F. Monds, Terre Haute, Ind.

[73] Assignee: Bemis Company, Inc., Minneapolis, Minn.

[21] Appl. No.: 180,890

[22] Filed: Apr. 13, 1988

[51] Int. Cl.[4] ..... B66F 9/065

[52] U.S. Cl. ..... 414/739; 242/55.1; 280/79.4; 294/113; 414/589; 414/745.1

[58] Field of Search ..... 414/589, 745, 680, 729, 414/739, 732, 733; 29/234; 254/29 R, 134; 280/79.1 A; 242/55.1; 294/113, 92

[56] References Cited

U.S. PATENT DOCUMENTS

| | | | |
|---|---|---|---|
| 976,600 | 11/1910 | Rhodes | 254/29 R |
| 2,594,503 | 4/1952 | Sanderson | 254/29 R X |
| 3,612,298 | 10/1971 | Azuma | 414/15 |
| 3,834,668 | 9/1974 | Casey | 254/29 |
| 4,026,522 | 5/1977 | Dranselka | 254/30 |
| 4,607,823 | 8/1986 | Thomas | 254/134 |
| 4,692,087 | 9/1987 | Olsen | 414/589 X |

*Primary Examiner*—Frank E. Werner
*Assistant Examiner*—Donald W. Underwood
*Attorney, Agent, or Firm*—Senniger, Powers, Leavitt and Roedel

[57] ABSTRACT

A device for pulling a shaft from the core of a roll of web material, the device comprising a jack having a wheeled base, a head, and means for raising and lowering the head relative to the base. A shaft receiver is mounted on the head, the shaft receiver having a passage therein for receiving the shaft. The device further comprises a shaft gripper adapted to grip a shaft inserted into the shaft-receiving passage, permitting relative forward movement of the shaft in the passage but resisting relative rearward movement of the shaft in the passage, so that the device can be applied to the end of the shaft to grip the shaft in the passage and pulled to pull the shaft from the roll.

5 Claims, 2 Drawing Sheets

SHAFT HANDLING DEVICE

BACKGROUND OF THE INVENTION

This invention relates to a shaft handling device, and in particular to a device for gripping and manipulating a shaft, for example a shaft used in winding machines for winding a length of a web material on a core.

In the plastic film industry, long webs of sheet materials (plastic film) are produced and are wound on a core for convenient storage and handling. This is typically accomplished by friction fitting a core of cardboard or other suitable material over a steel winding shaft, mounting the shaft-mounted core in a winding machine, and winding the sheet material around the core. When the winding step is completed, the shaft, core, and roll of sheet material are removed from the winding machine, and the winding shaft is removed from the core. These winding shafts must be made quite heavy to withstand the weight of the roll, and their size and shape makes them difficult to grasp. Furthermore, because the rolls are typically on the floor or on a pallet, the shaft is often in an awkward position for workers to grasp them and pull them from the core. As a result, it is difficult, tiring, and time consuming for workers to pull the winding shafts from the cores.

Furthermore, once the winding shaft is removed, it must be held up while a new core is installed on it. Then the shaft with the core must be returned to the winding machine. Often two or more workers are required to handle the winding shafts.

SUMMARY OF THE INVENTION

It is among the objects of the present invention to provide a device to assist in the removal of a winding shaft from the core of a roll of web material; and to provide such a device that assists in the transportation and handling of such shafts. In particular it is among the objects of the present invention to provide such a device that can securely grip a shaft when applied to the shaft end; to provide such a device that allows relative forward movement of the shaft in the device but resists the relative rearward movement of the shaft in the device; to provide such a device that is adjustable to grip shafts at varying heights; to provide such a device that securely grips the shaft to assist in transporting the shaft; and to provide such a device from which the shaft can be readily removed when desired.

Generally, a device for pulling a shaft from the core of a roll of web material constructed according to the principles of this invention comprises a jack having a wheeled base, a head, and means for raising and lowering the head relative to the base. A shaft receiver is mounted on the head and has a passage therein for receiving a shaft. The device further comprises a shaft gripper adapted to grip a shaft received in the shaft receiving passage. The gripper permits relative forward movement of the shaft in the shaft-receiving passage, but resists relative rearward movement of the shaft in the passage so that the device can be applied to the end of a shaft to grip the shaft in the passage, and pulled to pull the shaft from the roll.

The gripper preferably comprises first and second ends. The first end is pivotally mounted to the shaft receiver and the second end is resiliently biased into the shaft-receiving passage rearwardly of the first end. The second end of the gripper can thus pivot outwardly to accommodate the reception of, and relative forward advancement of, the shaft in the shaft-receiving passage. However, the gripper can pivot inwardly to engage the shaft and resist withdrawal of the shaft from the front end of the device. Thus the device can be advanced over the shaft to grip the shaft, and can be pulled to pull the shaft from the roll.

The device of the present invention thus assists in the removal, transportation and handling of winding shafts and the like. The device can readily receive and grip a shaft inserted therein, yet the device allows the shaft to be readily removed when desired. The device can be readily raised or lowered by operating the jack to raise or lower the shaft receiver. The device securely grips and supports the shaft, and provides for convenient transportation of the shaft by simply rolling the floor jack to the desired destination.

These and other features will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
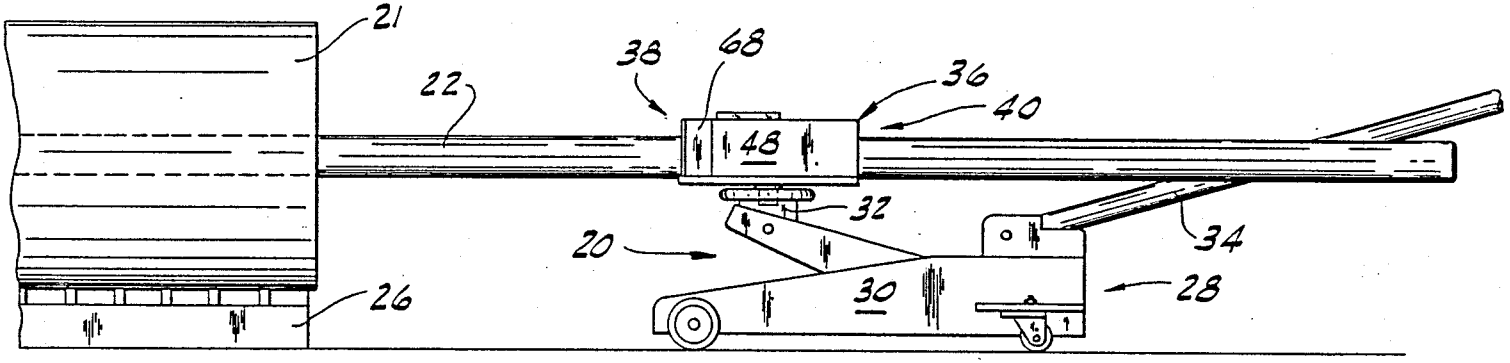
FIG. 1 is a side elevation view of a shaft handling device constructed according to the principles of this invention with a shaft gripped therein.
Figure 2:
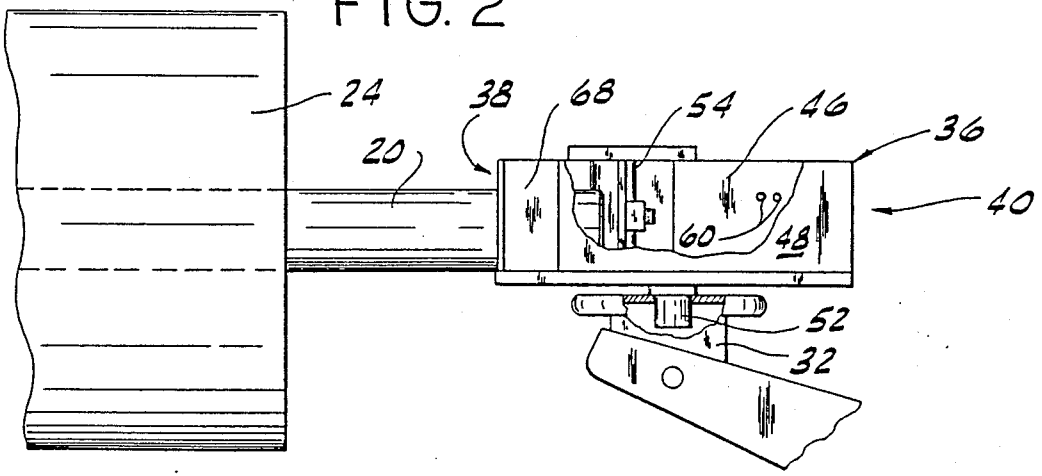
FIG. 2 is a side elevation of the device with a portion of the sidewall broken away to illustrate the insertion of a shaft into the device.
Figure 3:
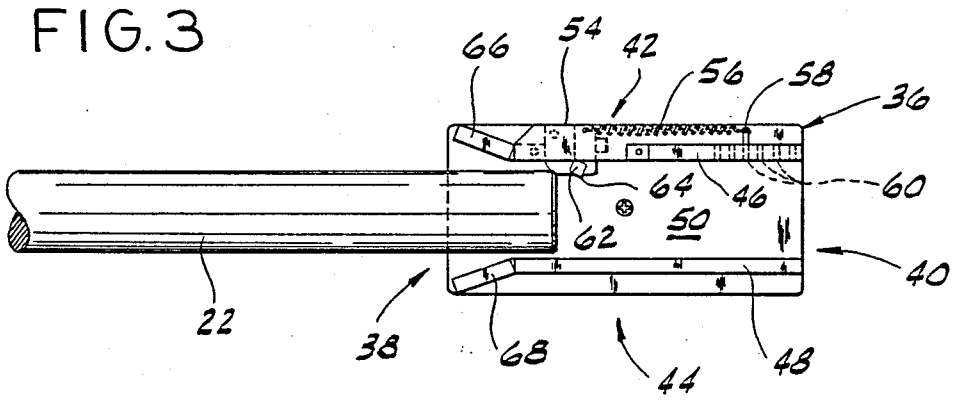
FIG. 3 is a top plan view of the device showing the insertion of a shaft into the device.
Figure 4:
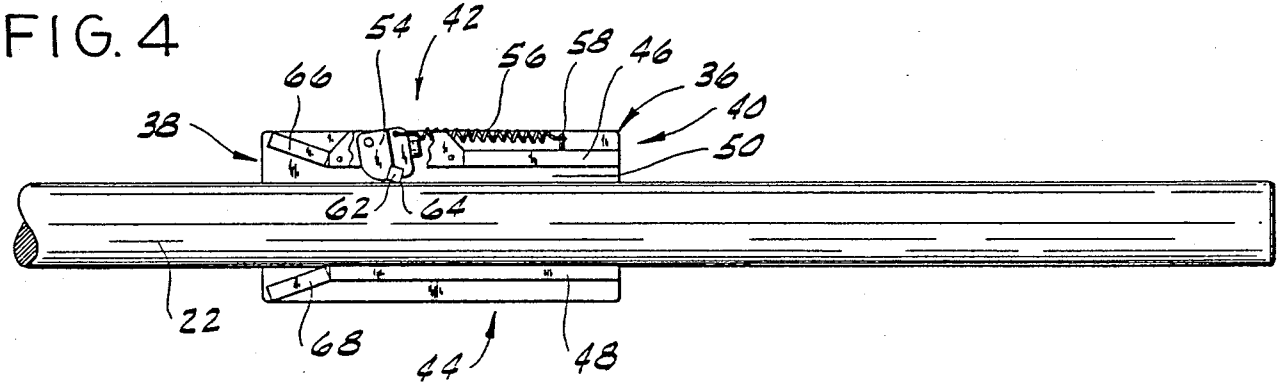
FIG. 4 is a top plan view of the device showing a shaft secured in the device.

A device for pulling a shaft from the core of a roll of web material constructed according to the principles of the present invention, indicated generally as 20, is shown in the FIG. 1 gripping a shaft 22 in order to remove the shaft from a roll 24 resting on a pallet 26. The device 22 comprises a jack 28 having a wheeled base 30, a head 32, and an actuator handle 34 for raising and lowering the head 32 relative to the base 30.

The shaft pulling device 20 comprises an elongate shaft receiver 36 in the form of a cradle, having a front end 38, a back end 40, and opposing sides 42 and 44. The cradle 36 comprises opposing first and second sidewalls 46 and 48 extending up on opposite sides of the bottom of the cradle 36, defining a passage 50 between them for receiving the shaft 24. The cradle 36 further comprises a stud 52 for pivotally mounting the cradle at its bottom to the head 32 of the jack 30.

The shaft pulling device 20 further comprises a shaft gripper 54, having first and second ends. The first end of the gripper 54 is pivotally mounted to the cradle 36, adjacent the first sidewall 46. The second end of the gripper 54 is preferably resiliently biased toward the second sidewall 48, into the shaft-receiving passage 50 rearward of the first end. In the preferred embodiment the means for resiliently biasing the second end of the gripper 54 is a coil spring 56, although some other other resilient biasing means could be used. One end of the spring 56 is attached to the gripper 54, and the other end of the sping 56 is attached to the cradle 36, for example to sidewall 46. In this preferred embodiment the spring 56 is attached to the sidewall 46 with a peg 58 which is adapted to fit in one of a plurality of longitudinally spaced holes 60 in the sidewall 46. The tension of spring 56, and thus the resilient biasing force on the gripper 54 can be adjusted by moving the peg 58 in the holes 60. The tension of the spring 56 resiliently biases the second end of the gripper 54 into the shaft-receiving passage 50, so that the gripper 54 resiliently urges shaft 22 against the second sidewall 48, thereby securing the shaft in the device.

The gripper 54 preferably comprises a bar 62 extending generally perpendicularly to the axis of the shaft-receiving passage 50. The bar 62 has a v-shaped edge 64 projecting into the shaft-receiving passage for engaging the shaft.

As described above, the second end of the gripper is preferably positioned rearwardly of the pivotally mounted first end. Thus, the second end of the gripper 54 can swing outwardly to accommodate the insertion of, and advancement of, the shaft 22 from the front end of the device but the gripper can pivot inwardly to engage the shaft and resist withdrawl of the shaft from the front end. The shaft pulling device 20 preferably has a pair of converging lips 66 and 68 at the foward end of the cradle 36 for channeling the shaft 22 into the shaft-receiving passage 50 between the sidewalls 46 and 48.

OPERATION

In operation, the shaft pulling device 20 is manipulated to the end of a roll 24 having a shaft 22 therein. The roll 24 may be on a pallet 26 or on the floor. The head 32 is raised or lowered to bring cradle 36 to the appropriate level by operating the actuator handle 34. When the cradle is at the appropriate level, the device is applied to the end of the shaft by advancing it over the end of the shaft so that the shaft enters the forward end of the device. The lips 66 and 68 direct the shaft 22 into the shaft-receiving passage 50 between the sidewalls 46 and 48. As the device 20 is advanced further over the shaft, the end of the shaft pushes the gripper 54, pivoting it out of the passage 50 so that the shaft can pass freely into the passage. However, the tension of spring 56 resiliently urges the gripper 54 into the passage 50, toward the second sidewall 48, to grip the shaft 22 between the v-shaped edge 64 of the bar 62 and the opposite sidewall 48. Because the v-shaped edge is substantially perpendicular to the axis of the shaft, it grips the shaft firmly, resisting relative rearward motion of the shaft in the passage. Thus the shaft can be inserted into the forward end of the device, and advanced in the device, but it cannot be withdrawn.

Once the device has a grip of the shaft 22, the device is pulled to pull the shaft out of the roll. When a portion of the shaft 22 has been pulled from the roll, the device is advanced on the shaft, the gripper 54 permitting the relative forward movement of the shaft in the device, but resisting relative rearward movement of the shaft in the device. The device is then pulled to pull more of the shaft from the roll, and the process repeated until the shaft is removed from the core.

When the shaft is firmly engaged in the device, the device can be used to transport the shaft by simply rolling the device to the desired location. The device can even support the shaft while a new core is installed over the ends of the shaft. The shaft is easily removed from the device by lifting the shaft from between the sidewalls 46 and 48, the gripper bar 62 providing little or no resistance to the removal of the bar in this direction.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for pulling a shaft from the core of a roll of web material resting on a floor or pallet with the roll axis generally horizontal, said apparatus comprising a jack having a base on wheels, a head, means for raising and lowering the head relative to the base, and a handle extending endwise in one direction from the base, a shaft receiver comprising an elongate cradle having a bottom and side walls extending up from the bottom and being open at both ends and at the top, the cradle being pivoted at its bottom on the head for rotation about a generally vertical axis, the inside of the side walls of the cradle being spaced a distance somewhat greater than the diameter of a shaft to be pulled for reception therebetween of the shaft and said side walls extending up from the bottom a distance greater than said spacing, said side walls being flared at one end of the cradle constituting its forward end, a shaft gripper associated with one of the side walls of the cradle for gripping a shaft extending lengthwise in the cradle, said gripper being mounted for movement relative to said one side wall to bring it into and out of gripping engagement with the respective side of a shaft in the cradle, and means biasing the gripper for movement toward gripping engagement with the shaft, said cradle being movable upwardly by operation of the jack by said handle with the handle extending in rearward direction relative to the cradle to bring the cradle to the level of a shaft in the core of a roll and generally aligned with the shaft with the forward end of the cradle toward the end of the shaft, and then movable forwardly by moving the jack forward for application to the shaft, the cradle being guided for alignment with the shaft between the flared forward ends of the side walls at the forward end of the cradle, the gripper being mounted for outward movement by the shaft as the cradle is moved forward to permit the endwise application of the cradle to the shaft and to permit forward movement of the cradle relative to the shaft, said gripper being movable in the direction for gripping engagement with the respective side of the shaft in the cradle, by engagement with the shaft on endwise movement of the cradle in rearward direction relative to its forward end, the cradle being adapted to support the shaft with the shaft extending from both ends of the cradle after the shaft has been pulled from the core and said gripper permitting removal of the shaft upwardly out of the open top of the cradle.

2. Apparatus as set forth in claim 1 wherein said gripper is pivoted for swinging movement on a generally vertical axis at said one side wall with an edge of the gripper inside said one side wall engageable with a shaft in the cradle.

3. Apparatus as set forth in claim 2 wherein the gripper extends from the pivot outside said one side wall and the biasing means comprises a spring connected between the gripper and said one side wall on the outside of the latter.

4. Apparatus as set forth in claim 3 having means for attaching the spring at various places on the outside of said one side wall for varying the bias on the gripper.

5. Apparatus as set forth in claim 3 wherein the gripper has a vertically extending bar of rectangular cross section on the inside of said one side wall, with an edge of this bar constituting said edge for engaging a shaft in the cradle.

* * * * *